US006167785B1

(12) United States Patent
Penner

(10) Patent No.: US 6,167,785 B1
(45) Date of Patent: Jan. 2, 2001

(54) TOOL FOR TURNING FASTENERS IN CONFINED SPACES

(76) Inventor: Vern Penner, 5810 - 264th Street, Aldergrove, British Columbia (CA), V4W 1P3

( * ) Notice: Under 35 U.S.C. 154(b), the term of this patent shall be extended for 0 days.

(21) Appl. No.: 09/123,873

(22) Filed: Jul. 28, 1998

(51) Int. Cl.[7] ..... B25B 13/06

(52) U.S. Cl. ..... 81/121.1; 81/124.3; 81/57.46; 81/180.1

(58) Field of Search ..... 81/121.1, 124.3, 81/488, 57.46, 57.39, 124.7, 180.1

(56) References Cited

U.S. PATENT DOCUMENTS

| | | | | |
|---|---|---|---|---|
| 519,354 | * | 5/1894 | Sheppard | 81/121.1 |
| 1,306,553 | | 6/1919 | Morrison . | |
| 2,187,399 | * | 1/1940 | Hopkins | 81/57.46 |
| 2,733,745 | | 2/1956 | Norwood . | |
| 3,124,983 | * | 3/1964 | Emerzian | 81/57.46 |
| 4,099,430 | | 7/1978 | Stodola . | |
| 4,224,844 | * | 9/1980 | Henriksen | 81/57.46 |
| 4,407,175 | | 10/1983 | Graham . | |
| 4,541,309 | | 9/1985 | Herrick . | |
| 4,592,254 | | 6/1986 | Wallis . | |
| 4,729,270 | | 3/1988 | Pritchard . | |
| 5,419,221 | * | 5/1995 | Cole | 81/60 |
| 5,794,496 | * | 8/1998 | Arnold | 81/60 |

* cited by examiner

*Primary Examiner*—David A. Scherbel
*Assistant Examiner*—Lee Wilson
(74) *Attorney, Agent, or Firm*—Oyen Wiggs Green & Mutala

(57) ABSTRACT

A tool for quickly removing or replacing threaded fasteners such as nuts or bolts has a spool-like body with an axial bore. A socket in the bore is dimensioned to engage a fastener. A flexible member can be wrapped around a circumferential channel in the body. A user can loosen or tighten A fastener by wrapping the flexible member around the channel and pulling on a pull ring on the free end of the flexible member. The tool is particularly well adapted to removing or tightening nuts or bolts in constricted spaces such are encountered when repairing automotive engines or other machinery. The tool is simple and inexpensive to manufacture. The tool may be provided in a kit having several tools for turning fasteners of several standard sizes.

21 Claims, 9 Drawing Sheets

TOOL FOR TURNING FASTENERS IN CONFINED SPACES

FIELD OF THE INVENTION

This invention relates to a tool for loosening or tightening fastener heads, such as nuts, bolts or the like in confined spaces. The tool includes a drive socket. A user can rotate the drive socket by pulling on a flexible member wound around a drum.

BACKGROUND OF INVENTION

When repairing automobiles, machinery or other equipment, a mechanic will often encounter fasteners which are in awkward confined locations. Removing or installing such fasteners can be very tedious because in constricted locations there is often not enough room to swing the handle of a conventional wrench through more than a very short stroke. As a result, a mechanic needs to engage the conventional wrench with the nut, push the wrench handle to turn the fastener through a few degrees, disengage the wrench, re-engage the wrench in a different orientation and repeat the process until the fastener has been removed or tightened, as the case may be. This is not only tedious but exposes the mechanic to the risk of skinned knuckles.

For some specific applications, such as the bolts on automotive distributor assemblies, there are commercially available wrenches having handles which are bent into a shape which allows the wrench to reach into the confined space while one end of the wrench handle is conveniently accessible to a user. These wrenches have the disadvantage that they are customized for specific applications. They are not generally useful.

A search of the prior art has located some tools which are designed to speed up the installation or removal of fasteners. These tools generally take the form of a conventional square drive ratchet wrench to which various sockets may be attached. The square drive can be caused to rotate rapidly about its axis to turn an attached socket without moving the wrench handle. Typically the square drive is caused to turn by means of a flexible member which can be pulled. U.S. Pat. Nos. 1,306,553; 4,541,309; 4,592,254; 2,733,745; 4,099,430; and 4,407,175 are examples of such prior art.

The above-noted tools are not well adapted for use in confined spaces. In such spaces they retain many of the disadvantages of conventional wrenches which they seek to replace. First, because they are designed to hold sockets which are to be fitted over top of a fastener head, these tools require significant clearance over the top of the fastener head before they can be used. There is often limited clearance over the top of fastener heads in confined spaces. Second, these tools are generally quite bulky. Third, all of these tools have handles. It can be difficult to maneuver a handled tool into some confined areas.

A further disadvantage of the tools described above is that a person using the tool must simultaneously hold the tool handle and pull on a flexible member, such as a cord, or the like to turn the socket. In a confined space this could be very awkward.

There is a long standing and continuing need for a tool which can be used to quickly turn the head of a fastener in a confined space so that the fastener may be easily removed or installed.

SUMMARY OF THE INVENTION

This invention provides tools which may be used to thread fasteners, such as nuts or bolts on or off. The tools are particularly well adapted for use in confined spaces. In one embodiment the invention provides a tool for tightening and loosening fasteners. The tool comprises a body having a bore extending axially therethrough. The body has a generally cylindrical outer surface and an inner surface. A socket is provided in the bore and a circumferential channel on the outer surface. a flexible member has one end attached to the body, a free end and a length capable of being wrapped more than once around the outer surface of the body within the circumferential channel. When the socket is engaged with a rotatable fastener with the flexible member wrapped around the body the fastener can be turned by pulling on the free end of the flexible member.

In preferred embodiments channel is defined between a pair of circumferential flanges. Most preferably one of the circumferential flanges comprises a notched circumferential edge. a hand grip is preferably attached to the free end of the flexible member.

In specific embodiments the socket comprises a twelve point socket, and a six point socket. Several tools according to the invention with sockets dimensioned to fit fasteners of different sizes may be provided in a kit.

BRIEF DESCRIPTION OF DRAWINGS

In drawings which illustrate a currently preferred embodiment of the invention, but which should not be construed as restricting the spirit or scope of the invention in any way.

DETAILED DESCRIPTION

Figure 1A:
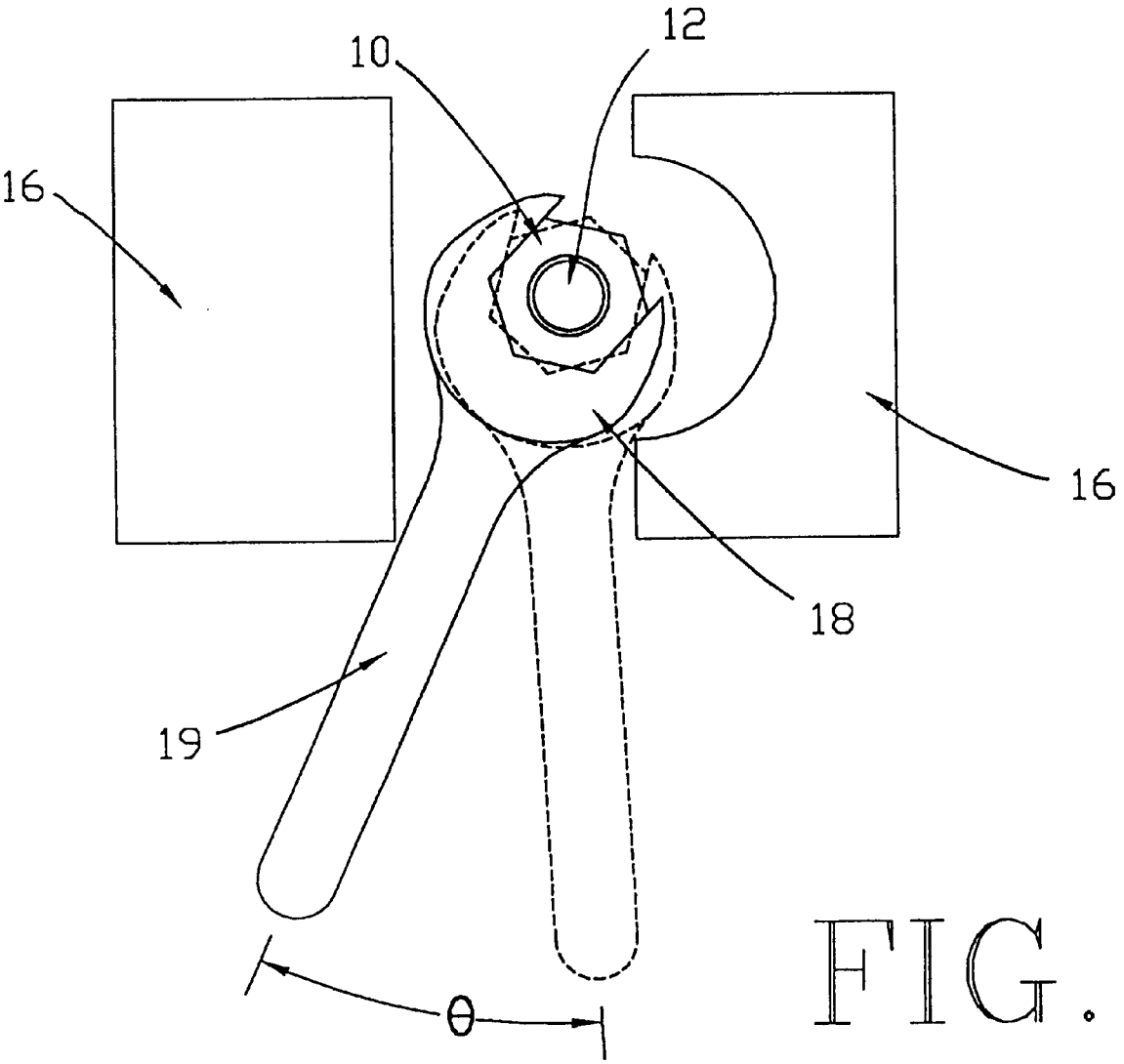
FIG. 1A is a top, plan cut-away view of a conventional prior art wrench being employed to engage a nut in a constricted space highlighting the significantly reduced range of motion and the subsequent reduction in ease and efficiency of use.
Figure 1B:
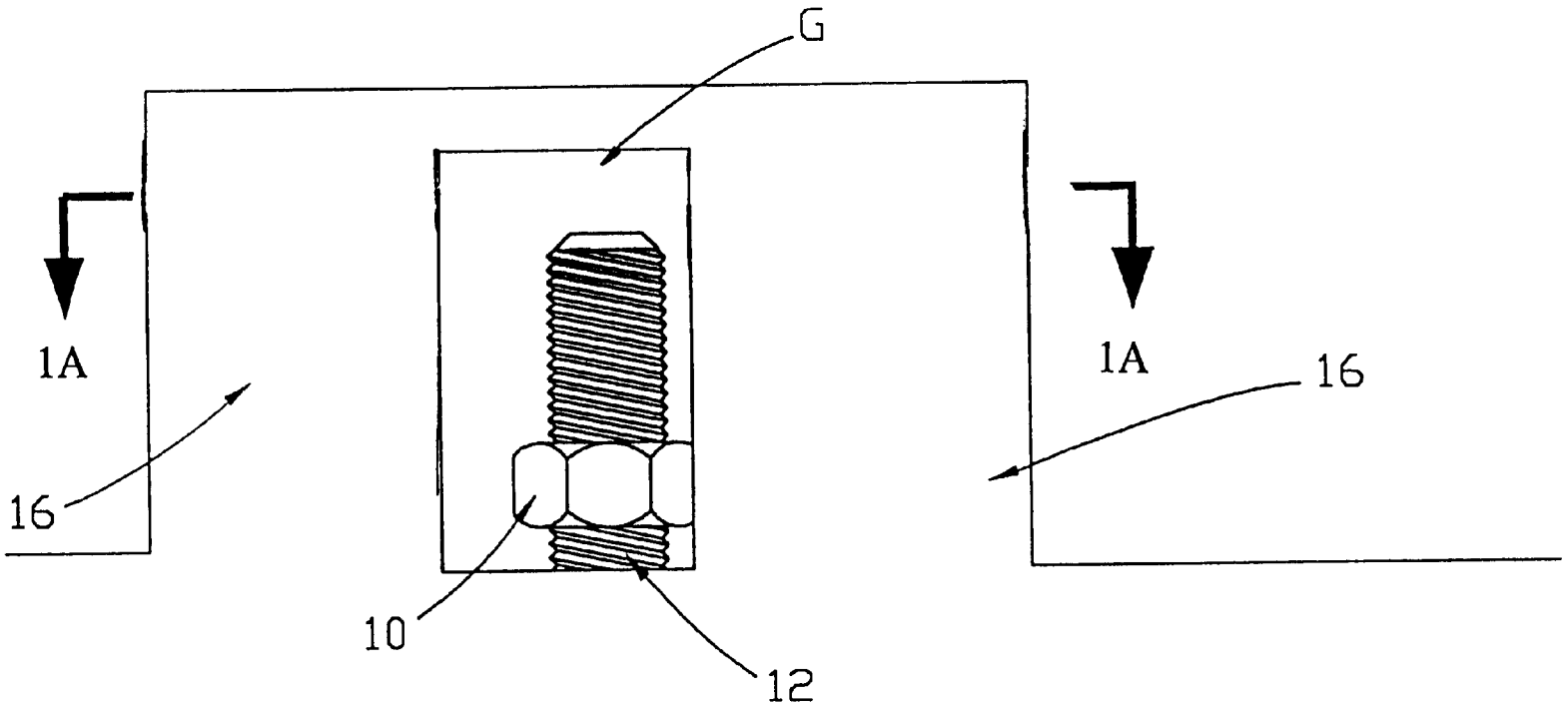
FIG. 1B is an elevational view of the stud shown in FIG. 1A.

FIGS. 1A and 1B show a nut 10 threaded onto a stud 12. Stud 12 is located near some obstructions 16. It can be seen that removing nut 10 from stud 12 with a conventional open-ended wrench 18 can be very tedious. Handle 19 of wrench 18 can be moved through an angle θ of only a few degrees, between the two positions shown respectively in solid and dashed outline, without hitting obstructions 16. As shown in FIG. 1B, obstruction 16 overlies stud 12 and thereby prevents the easy use of a socket wrench to turn nut 10. While the example of FIGS. 1A and 1B is somewhat contrived there are many cases where it becomes necessary to turn a fastener located in a similarly constricted location.

Figure 2:
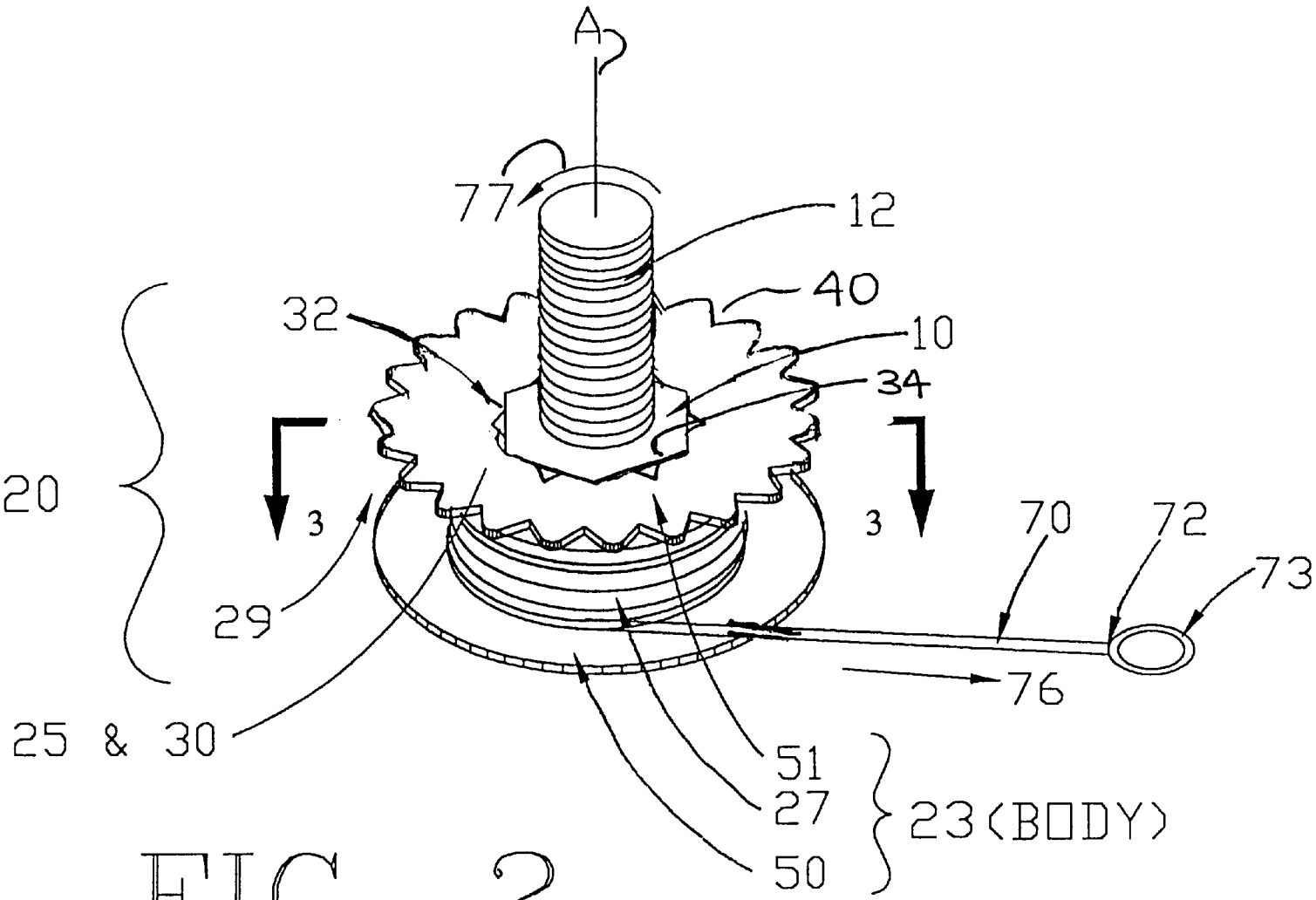
FIG. 2 is a top, isometric view of a tool according to this invention engaged on a nut to be removed.

FIG. 2 illustrates a tool 20 which may be used to spin a fastener, such as nut 10 or a bolt (not shown) on or off. Tool 20 has a generally cylindrical body 23. A bore 25 (FIG. 3) extends axially through body 23. Body 23 has a generally cylindrical outer surface 27. Preferably outer surface 27 and bore 25 are concentric and are each symmetrical about a central axis A. A channel 29 is formed in outer surface 27. In the embodiment of FIG. 2, channel 29 is defined between two circumferential protrusions or "flanges" 50, 51.

Bore 25 has an inner surface 30. Inner surface 30 defines a socket 34 for engaging a fastener drive head, such as a nut or the head of a bolt or the like. In the preferred embodiment of FIG. 2, inner surface 30 has twelve generally triangular ribs 32 which project inwardly from inner surface 30 to form socket 34. Ribs 32 provide a standard twelve-point socket 34. In general, socket 34 can engage two or more sides of nut 10. The twelve-point socket 34 of FIG. 2 can engage with sides of a hexagonal drive head, such as nut 10.

A flexible member 70, such as a cable, strap or the like is attached to body 23 such that the cable has one free end 72. A grasping handle, such as a pull ring 73 is preferably provided on free end 72. Flexible member 70 may be wrapped around outer surface 27 of body 23 in channel 29.

The use of tool 20 will now be clear to anyone skilled in the art. If the fastener in question is tight, the fastener is first loosened in a conventional manner, for example, by using a conventional open-ended wrench. Tool 20 is not designed to provide enough torque to break loose a tight fastener or to finally tighten a fastener. Because tool 20 is not required to bear such torques during normal operation it is not necessary for socket 34 to be made of especially strong materials. Body 23, including socket 34 may, for example, be made from a suitable high impact plastic.

Flexible member 70 is first wrapped around body 23 as described above. Body 23 is then placed over the fastener in question (for example, nut 10) with socket 34 engaging the fastener. After tool 20 has been engaged with the fastener, as in FIG. 3, the free end 72 of cable 70 can be pulled. Pulling on flexible member 70 in the direction of arrow 76 causes tool 20 to rotate around its central axis A in the sense indicated by arrow 77. Because nut 10 is engaged with socket 34, nut 10 rotates with body 23.

Flexible member 70 is preferably long enough to wrap at least several times around channel 29. This makes it possible for a fastener such as nut 10 to be turned through several complete revolutions before it is necessary to wrap flexible member 70 around channel 29 again. Most preferably flexible member 70 is long enough that it can be wrapped around channel 29 at least 5 to 10 times. Flexible member 70 should not be too long or too thin. A long thin flexible member 70 would be prone to becoming tangled if tool 20 is not carefully stored.

Preferably socket 34 is dimensioned to fit snugly on a standard-sized fastener. A tight fit between the socket 34 and nut 10 helps to ensure that socket 34 will stay engaged with nut 10 as nut 10 rotates and moves along stud 12.

Figure 3:
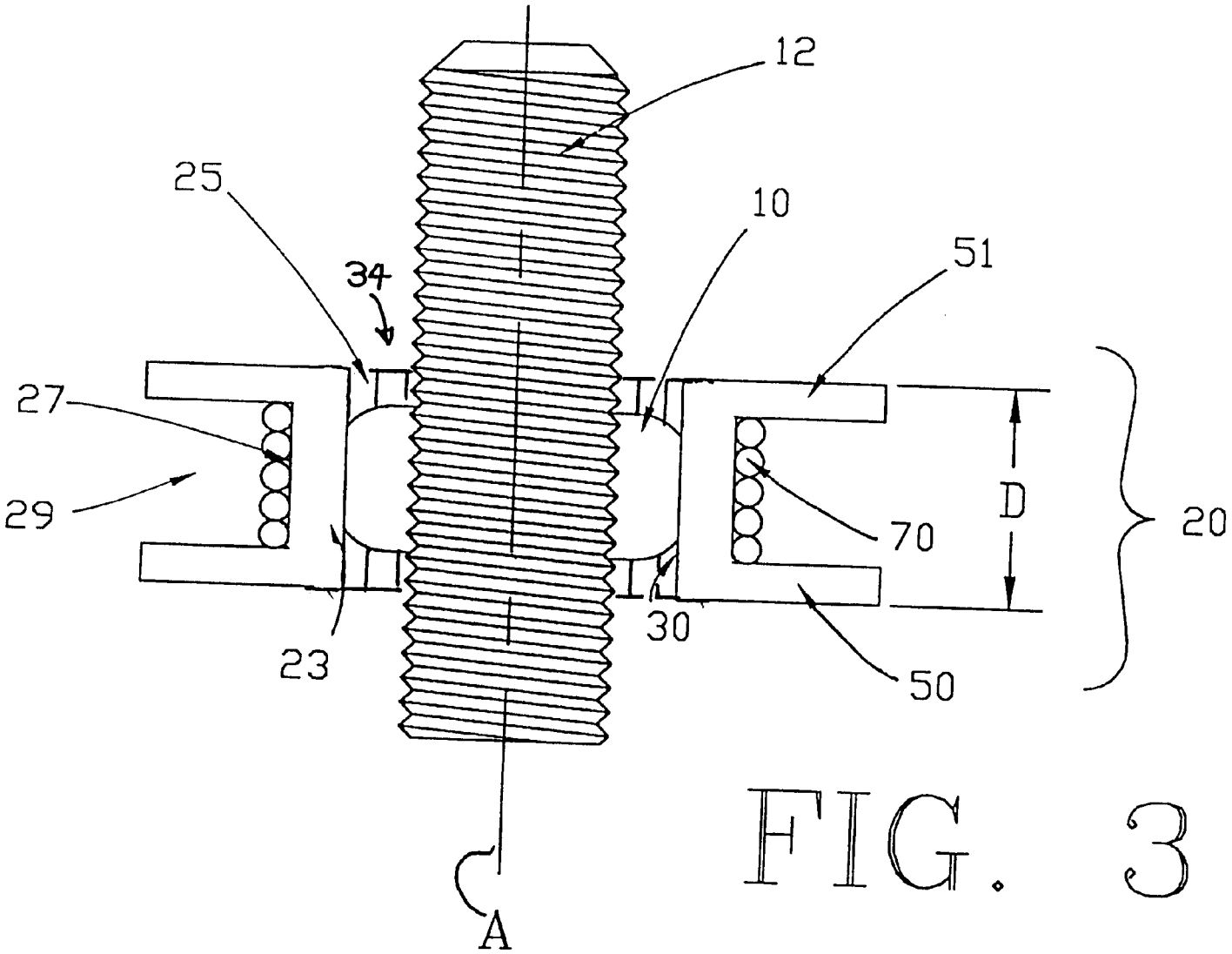
FIG. 3 is an elevational cross sectional view on the lines 3—3 of the tool of FIG. 2 in a constricted space while it is engaged with a nut.
Figure 4:
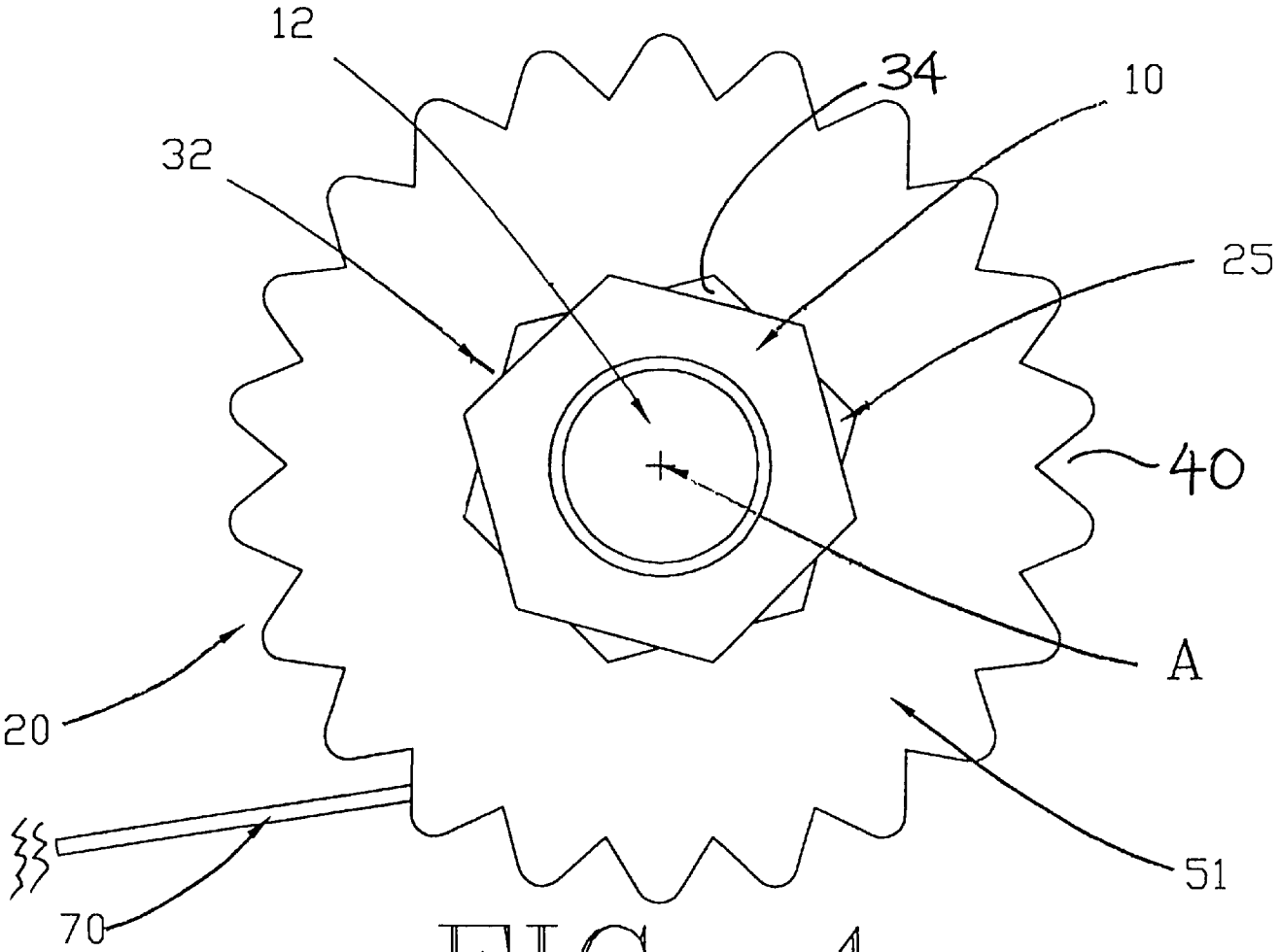
FIG. 4 is a top plan view of the tool of FIG. 2 in a constricted space while it is employed over a nut.
Figure 8:
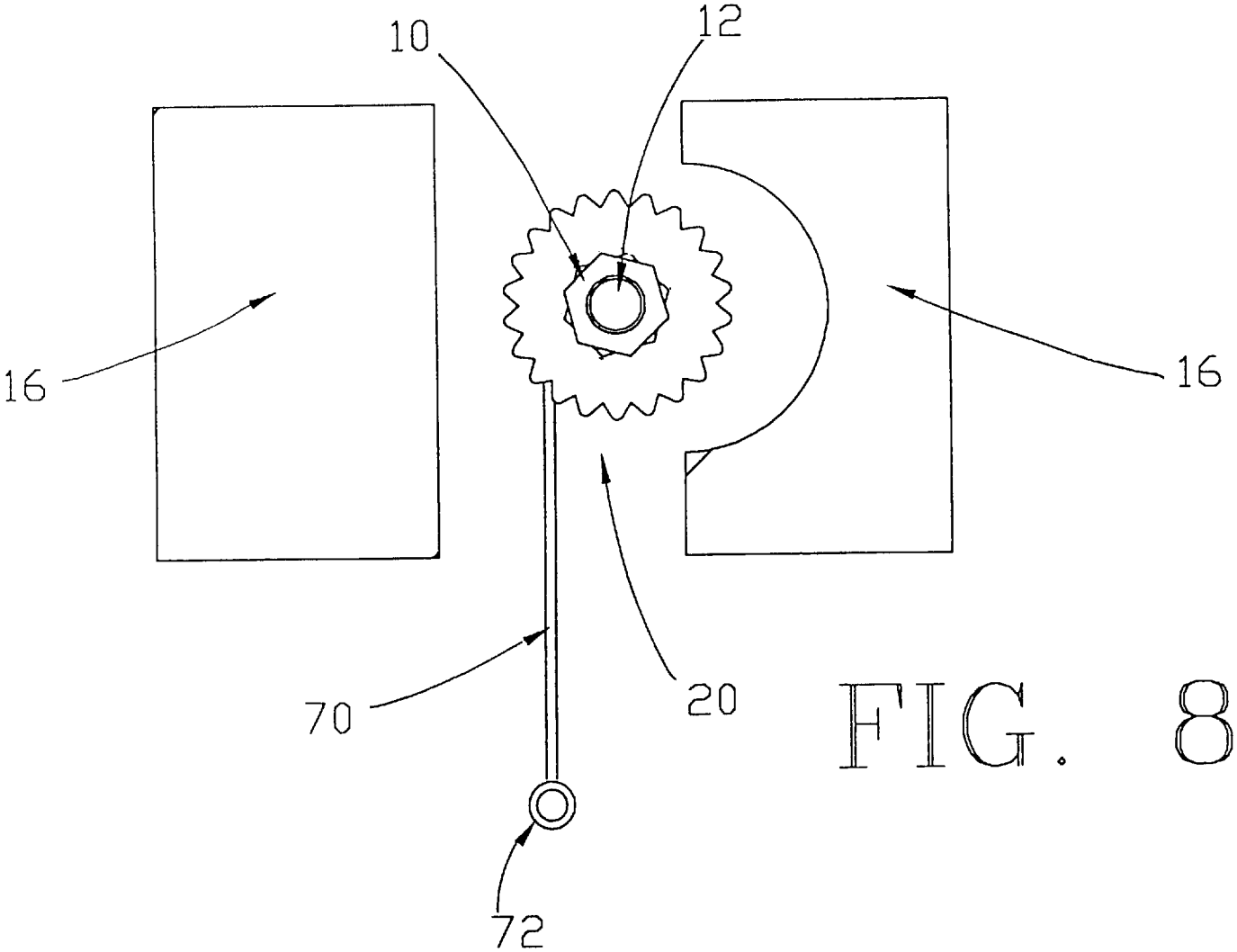

As shown in FIGS. 3 and 4 the dimension D of a tool 20 can be much smaller than the equivalent dimension of a standard ratchet wrench equipped with a socket. Tool 20 can therefore be slipped into small spaces, such as gap G of FIG. 1B which extends between the top end of stud 12 and obstruction 16. FIG. 8 shows tool 20 being used to turn the nut 10 of FIG. 1A. U.P. Dimension D is preferably about the same as the thinkness of a nut. U.P.

A feature of tool 20 is that channel 29 is radially directly outward from socket 34. As a result, when a user pulls on flexible member 70, tool 20 does not tend to be pulled off of nut 10 (or another fastener engaged by socket 34). In other words, tool 20 does not tend to tilt relative to axis A as flexible member 70 is pulled. It is unnecessary to provide a handle or other stabilizing means to hold body 23 as tool 20 is used. This makes it possible to make a tool 20 which is simpler, less expensive to make and less bulky than the prior art wrenches described above.

Normal ratcheting socket wrenches have a limited depth. Such wrenches therefore cannot be used to turn nuts which are threaded onto very long studs. The ends of the studs would prevent the sockets from reaching the nuts. Tool 20 has a through bore 25. Consequently tool 20 can be used to turn nuts on studs of any length.

Notches or serrations 40 (FIG. 2) may be provided around the periphery of one or both of flanges 50, 51. A user can push on notches 40 with a suitable implement, such as the end of a screwdriver, to help to turn tool 20 if the fastener being turned (e.g. nut 10) sticks while it is being turned.

Figure 5:
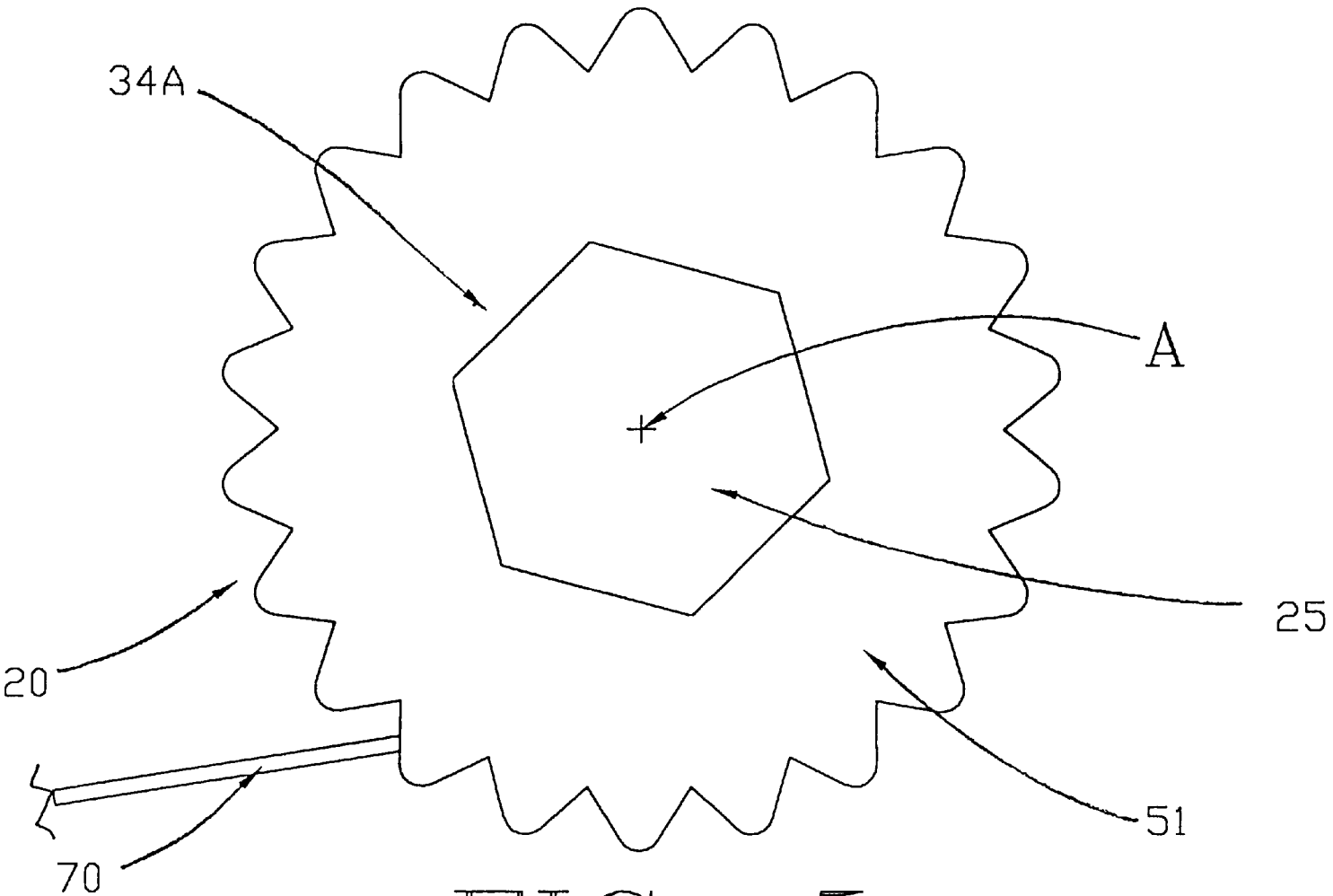
FIG. 5 is a top plan view of a first alternative embodiment of the tool which has a 6 point socket.
Figure 6:
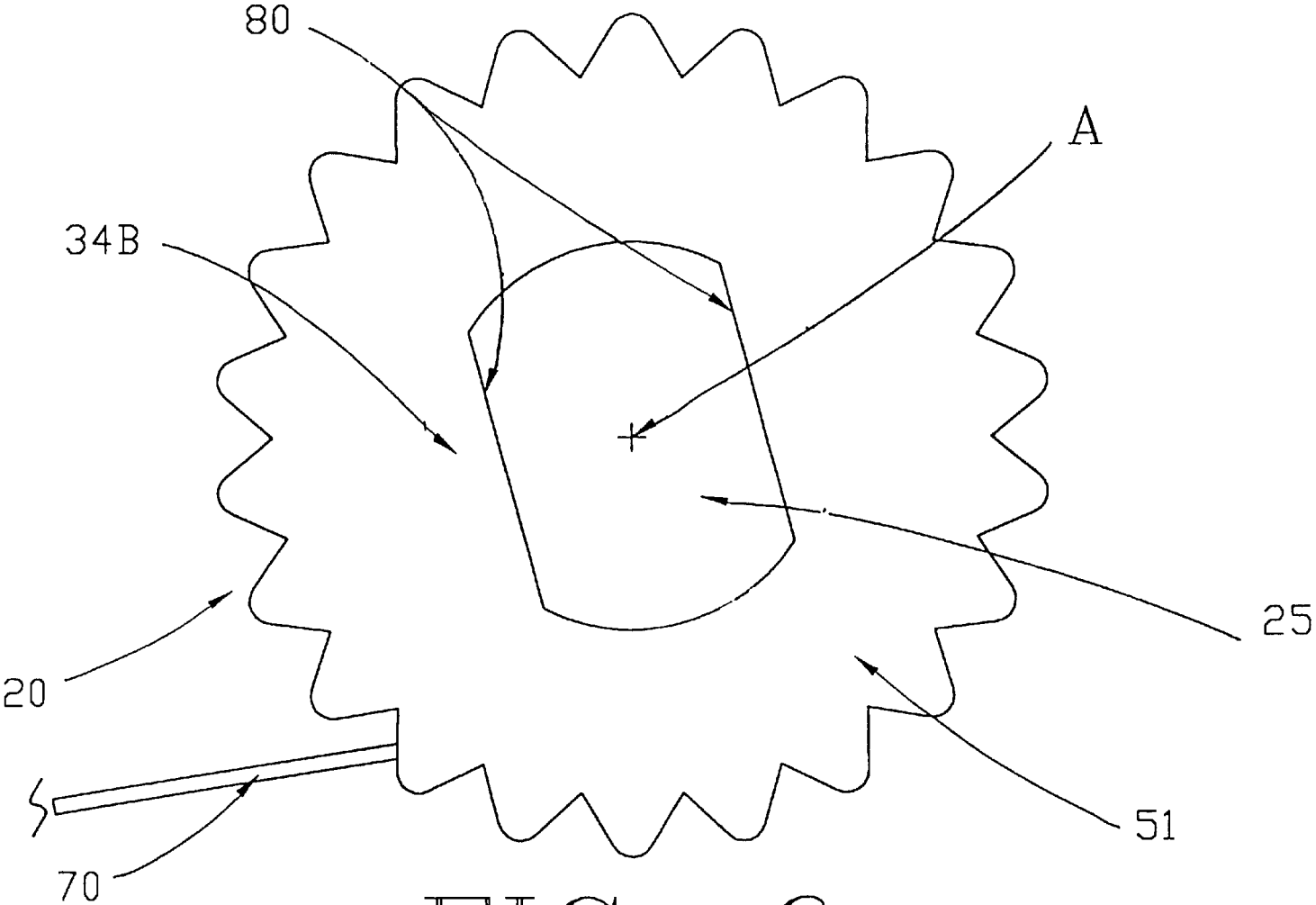
FIG. 6 is a top, plan view of a second alternative embodiment of the tool which has a rectangular configuration socket.

As should be apparent from the above description, many variations and modifications may be made to tool 20 without departing from the spirit or scope of the invention. By way of example only, tool 20 may be made from various materials. Body 23 of tool 20, including socket 34 and channel 29 may, for example be molded as a single unitary part of a suitable plastic or a suitable metal alloy. Socket 34 may take various forms. For example, FIG. 5 shows a tool 20 having a socket 34A which has a six point (hexagonal) configuration. FIG. 6 shows a tool 20 having a socket 34B which comprises a pair of parallel opposed flat surfaces 80 which extend along the entire length of bore 25 and are equidistant from axis A. Tool 20 may be provided with sockets 34 dimensioned to fit other shapes of fastener, such as square fasteners.

Figure 7:
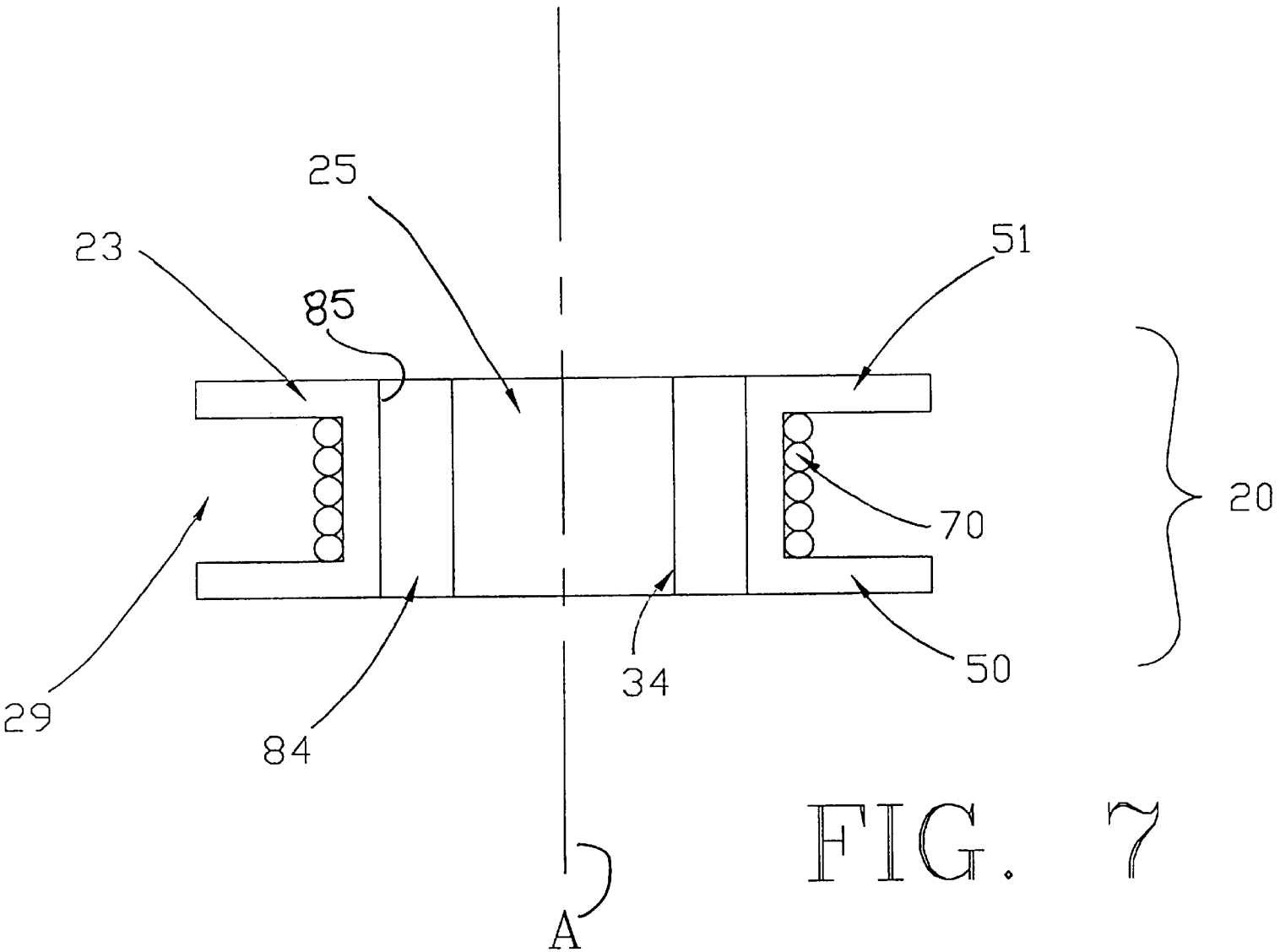
FIG. 7 is a sectional view of a third alternative embodiment of the tool wherein the socket is on a replaceable insert; and, FIG. 8 is a top plan cut away view of a tool according to the invention being used to remove a nut from the stud shown in FIGS. 1A and 1B.

Socket 34 may be provided on a removable insert 84 (FIG. 7). Insert 84 may be detachably and non-rotatably received within a bore 85 in any suitable way. For example, insert 84 and bore 85 may be non-round in section or insert 84 may comprise one or more projections which engage corresponding recesses in bore 85. This permits a single body 23 to be fitted with any one of a set of several different interchangeable inserts 84. Each insert 84 may have a differently sized socket 34.

Tool 20 may be manufactured and made available as a kit comprising several tools 20 each having a socket 34 dimensioned to fit a different standard sized fastener. The kit may comprise tools 20 having sockets 34 shaped to fit different types of fastener. For example, a kit including tools 20 having sockets 34 sized to fit hexagonal nuts or bolts of sizes ½ inch, 9/16 inch, ⅝ inch, and ¾ inch would cover a large proportion of the fasteners typically encountered in repairing machinery made in the United States. Tools 20 could also be provided in a kit in sizes for the most commonly encountered metric fasteners. For example, such a kit could include tools 20 with sockets 34 dimensioned to fit hexagonal nuts or bolts of sizes 10 mm, 11 mm, 12 mm, 13 mm and 14 mm.

The outer surface 27 of body 23 is generally cylindrical. Outer surface 27 does not need to be circular but could be faceted or could comprise a number of longitudinal ribs or the like. All that is necessary is that flexible member should be able to wrap around body 23 in channel 29 in such a manner that the parts of flexible member in channel 29 which bear against outer surface 27 are more or less equidistant from axis A.

Flexible member 70 may comprise cable, cord, a strap, or any other strong flexible element capable of being wound around channel 29 and pulled to turn body 23 as described above. The length of flexible member 70 may be varied as described above.

The diameter of body 23 may be varied. Increasing the diameter of body 23 makes it possible to deliver greater torque to a fastener at the expense of greater bulk and the need to pull more of flexible member 70 to turn body 23 through a given number of revolutions.

In light of the foregoing, the scope of the invention is to be construed in accordance with the substance defined by the following claims.

What is claimed is:

1. A tool for tightening and loosening fasteners, the tool comprising:

(a) a body having a bore extending axially therethrough, the body having a generally cylindrical outer surface and an inner surface;

(b) a socket in the bore, the socket including at least one pair of opposed parallel surfaces in the bore adapted to engage opposed parallel surfaces of a fastener;

(c) a circumferential channel on the outer surface;

(d) a flexible member having one end attached to the body, a free end and a length capable of being wrapped more than once around the outer surface of the body within the circumferential channel;

whereby, when the socket is engaged with a rotatable fastener with the flexible member wrapped around the body then the fastener can be turned by pulling on the free end of the flexible member.

2. The tool of claim 1, wherein the channel is defined between a pair of circumferential flanges.

3. The tool of claim 1, wherein the body is cylindrical.

4. The tool of claim 1 comprising a hand grip is attached to the free end of the flexible member.

5. The tool of claim 4 wherein the hand grip comprises a pull ring.

6. The tool of claim 4 wherein the flexible member has a length sufficient to wrap completely around the channel at least twice.

7. The tool of claim 6 wherein the socket comprises a plurality of longitudinally extending ridges spaced apart around the inner surface.

8. The tool of claim 7 wherein the socket has exactly twelve ridges evenly spaced around the bore to form a 12 point socket.

9. The tool of claim 1 wherein the channel and the socket are both symmetrical about a central axis of the bore.

10. The tool of claim 1 wherein the socket is formed on a removable insert and the removable insert is non-rotatably engageable in the bore with the channel and the socket both symmetrical about a central axis of the bore and the socket located radially inwardly of the channel.

11. The tool of claim 1 wherein the flexible member has a length sufficient to wrap completely around the channel at least five times.

12. The tool of claim 1 comprising a hand grip attached to the free end of the flexible member, wherein the flexible member has a length sufficient to wrap completely around the channel five to ten times.

13. A tool for tightening and loosening fasteners, the tool comprising:

(a) a body having a bore extending axially therethrough, the body having a generally cylindrical outer surface and an inner surface;

(b) a socket in the bore;

(c) a circumferential channel on the outer surface, wherein the channel is defined between a pair of circumferential flanges and wherein one of the circumferential flanges comprises a notched circumferential edges (d) a flexible member having one end attached to the body, a free end and a length capable of being wrapped more than once around the outer surface of the body within the circumferential channel;

whereby, when the socket is engaged with a rotatable fastener with the flexible member wrapped around the body then the fastener can be turned by pulling on the free end of the flexible member.

14. The tool of claim 13 wherein notches on the circumferential edge comprise radially extending surfaces wherein the body may be turned by pushing on the radially extending surfaces with a push member oriented generally tangentially to the circumferential edge.

15. The tool of claim 14 wherein the notches are evenly spaced apart around the circumferential edge.

16. The tool of claim 13 wherein the socket comprises at least one pair of opposed parallel surfaces in the bore.

17. The tool of claim 16 wherein the bore is hexagonal in cross section, the inner surface of the bore comprises three pairs of opposed surfaces and the three pairs of opposed surfaces define the socket has three pairs of opposed surfaces defining a hexagonal bore.

18. A tool for tightening and loosening hexagonal fasteners, the tool comprising:

(a) a body having a bore extending axially therethrough, the body having a generally cylindrical outer surface and an inner surface;

(b) a socket in the bore, the socket shaped to nonrotationally receive a hexagonal fastener;

(c) a circumferential channel on the outer surface; and (d) a flexible member having one end attached to the body, a free end and a length capable of being wrapped more than once around the outer surface of the body within the circumferential channel;

whereby, when the socket is engaged with a rotatable hexagonal fastener with the flexible member wrapped around the body then the fastener can be turned by pulling on the free end of the flexible member.

19. The tool of claim 18 wherein the socket comprises a plurality of ribs projecting inwardly into the bore, the ribs located to engage corners of a hexagonal fastener received in the bore.

20. The tool of claim 18 wherein the socket is hexagonal and provides three pairs of opposed parallel surfaces capable of bearing against faces of a hexagonal fastener.

21. The tool of claim 18 wherein the socket is on an insert detachably and non-rotatably affixed within the bore.

* * * * *